United States Patent [19]

Prins

[11] Patent Number: 4,471,700

[45] Date of Patent: Sep. 18, 1984

[54] RAIL VEHICLE ASSEMBLY

[76] Inventor: Petrus D. Prins, 55 Basson Dr., Glenvista, Johannesburg, South Africa

[21] Appl. No.: 325,122

[22] Filed: Nov. 25, 1981

[30] Foreign Application Priority Data

Nov. 28, 1980 [ZA] South Africa ..... 80/7433
Dec. 19, 1980 [ZA] South Africa ..... 80/7935

[51] Int. Cl.[3] ..... B61F 3/12
[52] U.S. Cl. ..... 105/4 R; 280/408
[58] Field of Search ..... 105/4 R, 4 A; 280/408, 280/442; 180/14.1

[56] References Cited

U.S. PATENT DOCUMENTS

| | | | |
|---|---|---|---|
| 1,654,814 | 1/1928 | Jonkhoff | 105/4 R |
| 2,115,095 | 4/1938 | Bugatti | 105/4 R |
| 3,678,863 | 7/1972 | Pringle | 105/4 R |
| 3,687,085 | 8/1972 | Newman et al. | 105/4 R X |
| 3,696,757 | 10/1972 | Newman et al. | 105/4 R |

FOREIGN PATENT DOCUMENTS

| | | | |
|---|---|---|---|
| 9111 | 9/1932 | Australia | 105/4 R |
| 43097 | 5/1893 | Canada . | |
| 215919 | 2/1922 | Canada . | |
| 742911 | 9/1966 | Canada . | |
| 1,963,679 | 2/1979 | Fed. Rep. of Germany | 105/4 R |
| 154012 | 8/1932 | Switzerland | 4 R/ |
| 390036 | 3/1933 | United Kingdom . | |
| 771541 | 4/1957 | United Kingdom . | |
| 816,978 | 7/1959 | United Kingdom | 105/4 R |
| 1065557 | 4/1967 | United Kingdom . | |
| 1300372 | 12/1972 | United Kingdom . | |
| 1302089 | 1/1973 | United Kingdom . | |

*Primary Examiner*—Randolph Reese
*Attorney, Agent, or Firm*—Lowe, King, Price & Becker

[57] ABSTRACT

A rail vehicle assembly comprises two vehicles each with single wheelsets, and a third vehicle, also with a single wheelset, which serves to interconnect the first two vehicles and which in use exerts a steering action on the first two vehicles. The third vehicle is located between the first two vehicles and is pivotally connected thereto in such a way that the three vehicles can align themselves with the rail track, while negotiating a curve, so that all the wheelsets are maintained at all times substantially on radial lines of the curve.

7 Claims, 7 Drawing Figures

RAIL VEHICLE ASSEMBLY

BACKGROUND TO THE INVENTION

This invention relates generally to rail vehicles and more particularly to a hopper used for transporting ore.

The design of a hopper for underground use is subject at least to the constraint that the capacity of the hopper can be increased only by extending the length thereof since, due to the physical limitation of the size of the tunnel in which the hopper must operate, the maximum height and width of the hopper are fixed.

Long hoppers, however, are likely to derail or experience excessive wear and tear on the wheels, and rails, arising at curves and bends in the track. This is because of the incorrect geometrical location of the wheelsets relatively to the track as a bend is negotiated.

SUMMARY OF THE INVENTION

It is an object of the present invention to minimize this problem.

The invention provides a rail vehicle assembly which includes a first vehicle with a first wheelset, a second vehicle with a second wheelset, and a third vehicle with a third wheelset which is located between the first and second wheelsets, the first and second vehicles respectively being pivotally connected to the third vehicle.

In one form of the invention the first and second vehicles are pivotally interconnected, end to end.

In accordance with the invention the first vehicle is pivotally connected to the third vehicle at a point which in plan is approximately midway between the first wheelset and the third wheelset. The second vehicle is similarly connected to the third vehicle.

The pivotal connections permit relative angular movement of the vehicles in plan. A limited degree of angular movement, in elevation, is obtained by locating the pivotal connections in resilient rubber bushes or the like.

Preferably the first and second vehicles are interconnected at a first level and at a second level above the first level. At one of the levels use may be made of a link pivotally connected to each of the vehicles. This arrangement provides a coupling which is substantially rigid in the vertical direction.

The third vehicle applies an efficient steering action to the first and second vehicles, when negotiating a curve, which maintains each wheelset on radius lines of the curve. This ensures that the wheels are correctly aligned on the rails and, consequently, wear and tear of the wheels due to frictional drag are minimized.

Apart from the use of rubber bushes, or the like, already referred to, the ability of the first and second vehicles to negotiate a curve is improved by connecting these vehicles to the third vehicle using coupling means which permits limited pivotal movement of the respective vehicles, relative to the third vehicle, in the vertical direction.

These coupling means may include upper and lower bushes which are received in a suitable formation which permits a degree of rotational movement of one bush relative to the other.

The invention also extends to a train which comprises a plurality of the aforementioned vehicle assemblies, each vehicle assembly having first and second drawbars at opposed ends of the first and second vehicles respectively, with adjacent drawbars of adjacent vehicle assemblies being pivotally connected to each other.

The invention further provides a method of operating first and second rail vehicles which include first and second wheelsets respectively, the method including the steps of pivotally connecting the first and second vehicles to each other, and to a third rail vehicle with a third wheelset which is located intermediate the first and second wheelsets, whereby the point at which the first and second vehicles are pivotally interconnected can move laterally when the vehicles move along a curve.

BRIEF DESCRIPTION OF THE DRAWINGS

The invention is further described by way of examples with reference to the accompanying drawings in which.

DESCRIPTION OF PREFERRED EMBODIMENTS

Figure 1:
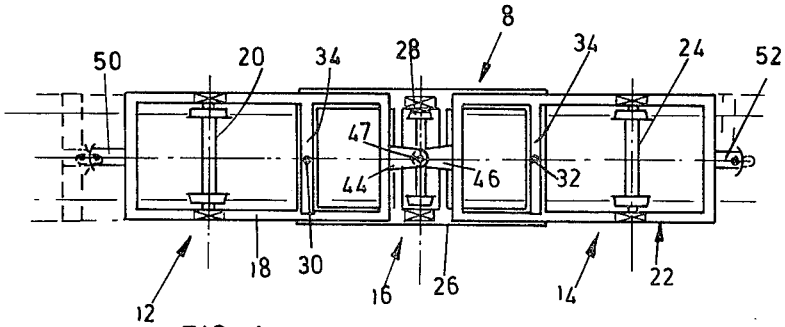
FIG. 1 is a plan view of a train including rail vehicle assemblies according to one form of the invention on a straight track.

FIG. 1 illustrates in plan a train including rail vehicle assemblies 10 according to one form of the invention. For the sake of clarity the upper structures of the vehicle assemblies i.e. the container sections have been indicated in dotted outline only.

Each vehicle assembly 10 consists of first and second vehicles 12, 14 respectively, and an intermediate vehicle 16.

The vehicle 12 has a chassis 18 and a wheelset 20. Similarly, vehicle 14 has a chassis 22 and a wheelset 24. The vehicle 16 has a chassis 26 and a centrally located wheelset 28.

Figure 5:
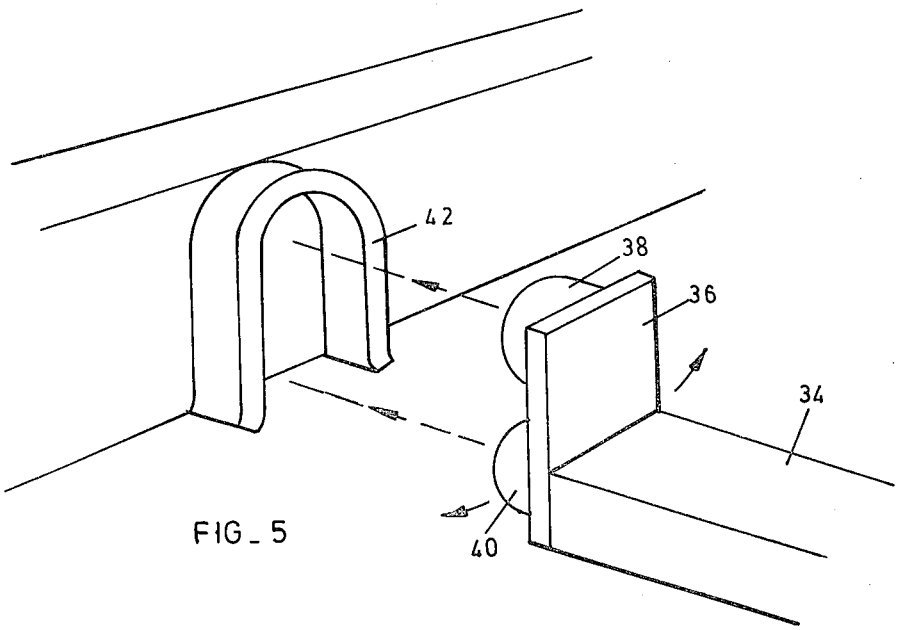
FIGS. 5 and 6 are perspective and side views respectively of a coupling used in a vehicle assembly of the invention.

The ends of chassis 26 which are parallel to wheelset 28 have central pivot points 30 and 32 respectively. Beams 34 are located on chassis 18 and 26, and are secured to these points. Each beam terminates at each end thereof in a flange 36 which carries two bushes 38, 40 respectively, and these bushes are engaged with a downwardly facing U-shaped member 42 carried by side members of each chassis 18, 22 (see FIG. 5) of the associated vehicle 12 or 14 respectively.

Figure 2:
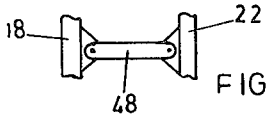
FIG. 2 is a fragmented view of a coupling employed in a rail vehicle assembly of the invention.

The two vehicles 12 and 14 have drawbars 44, 46 respectively which are pivotally interconnected at 47, and, above the interconnection, the vehicles are again interconnected by means of a link 48 which pivots relative to chassis 18 or 22 respectively, as shown in FIG. 2.

The vehicle assembly has drawbars 50 and 52 at opposed ends of the vehicles 12 and 14 so that it can be coupled to other vehicle assemblies to form a train.

In operation vehicle 16 exerts a highly efficient steering action on the adjacent vehicles 12, 14 which enables the vehicle assembly to negotiate sharp bends while keeping wheel slippage, and the tendency for the wheels to mount the rails to a minimum. Wear and tear is therefore reduced.

Figure 3:
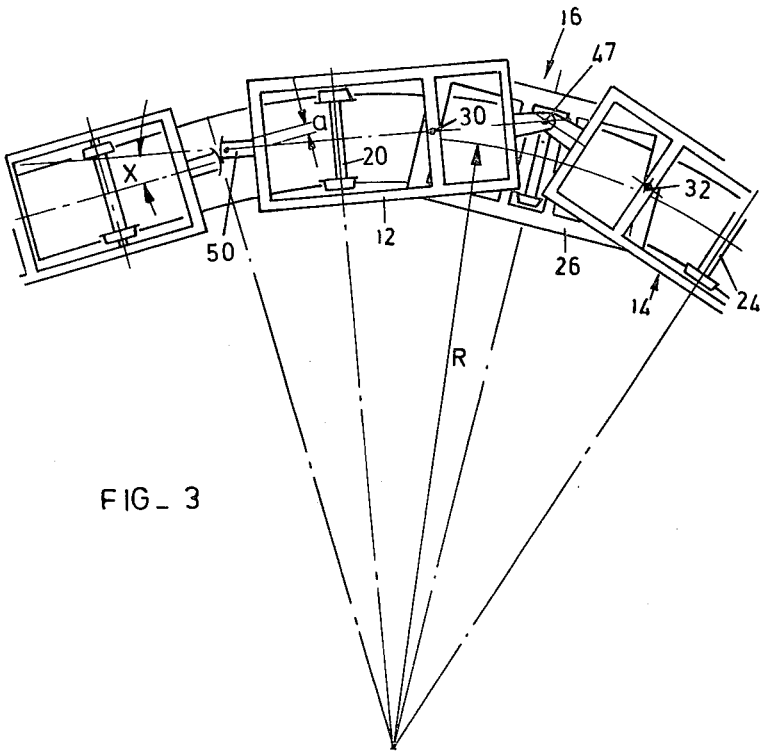
FIG. 3 is a view of the train of FIG. 1 entering a bend with one vehicle assembly on the bend and an adjacent vehicle assembly on a straight portion of track.

FIG. 3 illustrates the train on a curve of radius R. The degree of curvature has been over-emphasized for illustrative purposes only.

As the vehicle assembly 10 advances through the curve, vehicles 12 and 14 pivot on chassis 26 of the intermediate vehicle about points 30, 32. These points are substantially midway between the respective wheelsets 20, 24 and the central pivot point 47 and consequently each of the three wheelsets is located on a radius line of the curve. Thus the wheels are correctly aligned with the track and wear of the wheels and track is reduced. It should be mentioned at this point that the wheels could be fixed to the axles so that they are rotatable together with the axles but preferably the wheels are rotatable relative to the axles. This reduces slippage when bends are negotiated.

Figure 4:
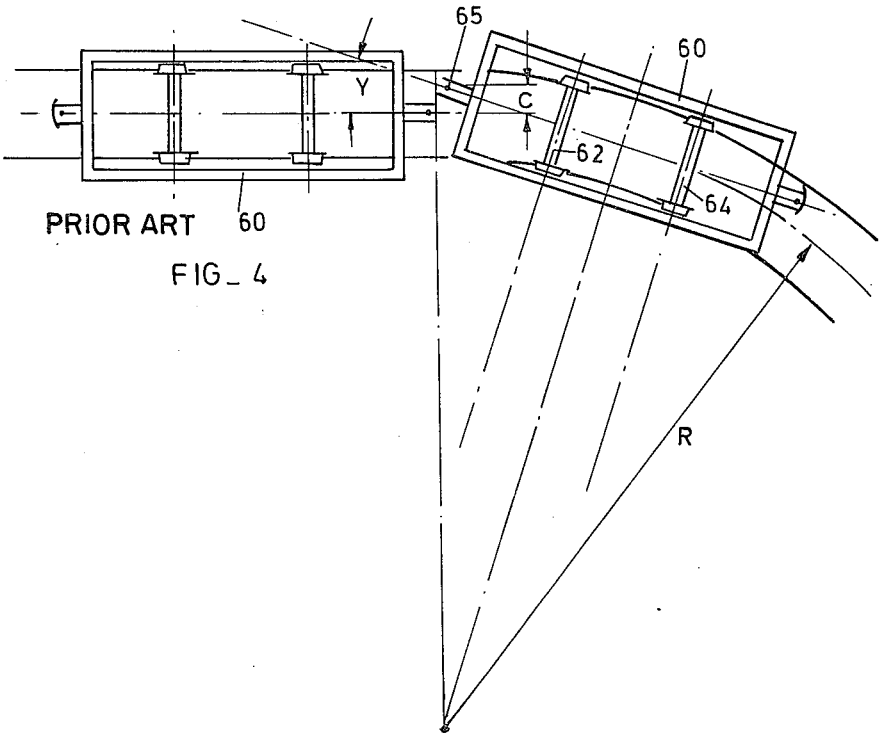
FIG. 4 is a view, similar to FIG. 3, of a train of conventional hoppers.

Another important benefit is related to the positions of the drawbars 50, 52 as the train enters or leaves the curve of the bend. Referring to FIG. 3, it can be seen that drawbar 50 is displaced by an amount "a" from the center line of the track, and subtends an angle X to the center line. Clearly the coupling between the drawbars of adjacent hoppers must be capable of handling a displacement of this magnitude. The displacement is, however, far less than what is the case under conventional conditions, shown for example in FIG. 4.

This Figure shows hoppers 60 with two wheelsets 62, 64 each, negotiating a bend. The drawbars 66 are displaced by an amount "c" which is greater than the amount "a" and subtend an angle Y to the center line of the track which is greater than the angle X shown in FIG. 3. The wheelsets 62, 64 are parallel to each other and do not lie on radius lines of the curve. All these drawbacks arise because of the non-steerable nature of the hopper and consequently the wear on the hopper and on the track is considerably greater than is the case with the vehicle assembly of the invention.

Figure 6:
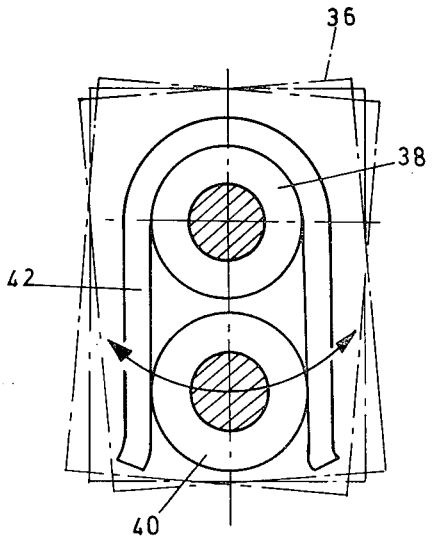

Referring again to FIG. 3 it can be seen that when vehicles 12 and 14 pivot about points 30, 32 a certain degree of non-rotational movement must be allowed for so that the pivoting action described can in fact take place. This movement is provided for, to some extent, by locating rubber bushes at all the pivot points. The construction shown in FIGS. 5 and 6 permits further relative lateral movement of the vehicles in that the lower bush 40 which is aligned with the beam 34 can rotate to a limited extent about the pivot point constituted by the upper bush 38. Since half of bush 38 is surrounded by member 42, the upper bush is deformable to a lesser degree than bush 40 and so the bush 40 in effect is rotatable about bush 38.

The essence of the invention lies in the steering action which is provided by the intermediate vehicle. The steering action ensures that the various wheelsets are geometrically correctly located on the tracks and thus wear is reduced.

The use of two vertically separated pivotal connections between the vehicles 12 and 14, see FIGS. 1 and 2, means that the vehicles stand correctly aligned if the intermediate vehicle 16 is removed, for the connections provide a coupling which is rigid in the vertical direction. This emphasizes that the primary function of the vehicle 16 is a steering function although, in practice, the vehicle does carry a proportion of the weight carried by the entire vehicle assembly.

The container sections of the vehicle assembly, shown in dotted outline in FIG. 1, are designed so that the mouth of each container extends towards the mouth of the adjacent container so that practically no gaps exist in the loading area of the train. In other words the train can be continuously filled by a suitable mechanism as it advances, preferably along a straight path.

Figure 7:
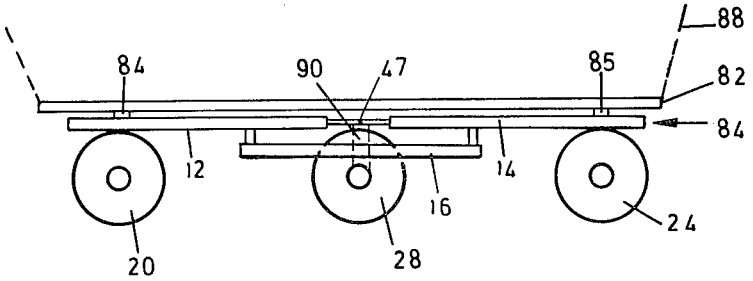
FIG. 7 illustrates an alternative arrangement of a vehicle assembly of the invention.

The vehicles 12, 14 and 16, although described as such, function essentially as bogies and any suitable container could be erected on the chassis of the vehicles. Thus it is not necessary to locate a separate container on each vehicle and each vehicle assembly could, in fact, have a single container, as shown diagrammatically in FIG. 7. This Figure illustrates that the vehicle 12 and 14 which are interconnected, as before, by means of the intermediate vehicle 16 together constitute a subframe 80 to which is secured an upper chassis 82 which is pivoted relative to the subframe about points 84 and 86. A container 88 is fixed to the chassis 82. In this example of the invention the wheelsets 20 and 24 are at the ends of the subframe 80 and consequently the central wheelset 28 is called upon to carry a greater proportion of the load than in the hopper of FIG. 1. This weight may be transferred directly to the axle of the wheelset 28 by means of a support 90 which is connected to the coupling 47 and which is movable along the axle when the subframe is articulated. Arrangements of this type are also intended to fall within the scope of the invention.

I claim:

1. A rail vehicle assembly which comprises a first vehicle with a single first wheelset, a second vehicle with a single second wheelset, and a third vehicle with a single third wheelset which is located between the first and second wheelsets, the first and second vehicles being pivotally connected, end to end, at a point overlying the third wheelset, means for pivotally connecting the first and second vehicles respectively directly to the third vehicle at points which in plan are approximately equidistant between the first wheelset and the third wheelset, and between the second wheelset and the third wheelset, respectively, said pivot points being laterally immovable with respect to the third wheelset.

2. An assembly according to claim 1, wherein the first and second vehicles are pivotally interconnected at a first level, and at a second level above the first level, a link being located at one of the levels pivotally connected to each of the first and second vehicles, said first and second vehicles standing correctly aligned if the third vehicle is disengaged from the first and second vehicles.

3. An assembly according to claim 1, wherein the first and second vehicles respectively include beams being pivotally connected to the third vehicle and which permit limited pivotal movement of said first and second vehicles, relative to the third vehicle and to the beams, in the vertical direction.

4. An assembly according to claim 1, wherein the first and second vehicles respectively includes a chassis and a beam being movable to a limited extent relative to each chassis, each beam being pivotally secured to the third vehicle.

5. An assembly according to claim 4, wherein each chassis of the first and second vehicle respectively includes a pair of downwardly facing U-shaped members and each respective beam includes a pair of bushes at opposite ends thereof respectively engaging with the U-shaped members.

6. An assembly according to claim 5, wherein said bushes are deformable.

7. An assembly according to claim 1, wherein said first and second wheelsets are respectively mounted on fixed axles, whereby said fixed axles are non-pivotable with respect to a chassis in each first and second vehicle respectively.

* * * * *